United States Patent [19]

Datta et al.

[11] 4,200,477

[45] * Apr. 29, 1980

[54] PROCESSING FOR ELECTROMAGNETIC SILICON STEEL

[75] Inventors: Amitava Datta; Clarence L. Miller, Jr., both of Pittsburgh; Jack W. Shilling, Monroeville, all of Pa.

[73] Assignee: Allegheny Ludlum Industries, Inc., Pittsburgh, Pa.

[ * ] Notice: The portion of the term of this patent subsequent to Jul. 25, 1995, has been disclaimed.

[21] Appl. No.: 887,098

[22] Filed: Mar. 16, 1978

[51] Int. Cl.[2] ..... H01F 1/04

[52] U.S. Cl. ..... 148/113; 148/16; 148/27; 148/31.5

[58] Field of Search ..... 148/16, 27, 31.5, 111, 148/112, 113; 427/127, 129

[56] References Cited

U.S. PATENT DOCUMENTS

| | | | |
|---|---|---|---|
| 2,867,557 | 1/1959 | Crede et al. | 148/111 |
| 3,151,005 | 9/1964 | Alworth et al. | 148/111 |
| 3,544,396 | 12/1970 | Taylor | 148/112 |
| 3,627,594 | 12/1971 | Yamamoto et al. | 148/113 |
| 3,700,506 | 10/1972 | Tanaka et al. | 148/111 |
| 3,868,280 | 2/1975 | Yamamoto et al. | 148/113 |
| 3,954,521 | 5/1976 | Malagari | 148/111 |
| 4,000,015 | 12/1976 | Malagari | 148/112 |
| 4,030,950 | 6/1977 | Schilling et al. | 148/113 |
| 4,054,471 | 10/1977 | Datta | 148/113 |
| 4,102,713 | 7/1978 | Schilling et al. | 148/113 |

*Primary Examiner*—L. Dewayne Rutledge
*Assistant Examiner*—John P. Sheehan
*Attorney, Agent, or Firm*—Vincent G. Gioia; Robert F. Dropkin

[57] ABSTRACT

A process for producing electromagnetic silicon steel having a cube-on-edge orientation. The process includes the steps of: preparing a melt of silicon steel having up to 0.07% carbon, from 0.01 to 0.25% manganese, from 0.01 to 0.09% of material from the group consisting of sulfur and selenium, from 2.5 to 4.0% silicon, up to 1.0% copper, less than 0.009% aluminum and less than 0.0006% boron; casting the steel; hot rolling the steel; cold rolling the steel; normalizing the steel in a hydrogen-bearing atmosphere having a $pH_2O/pH_2$ of from 0.015 to 0.3; applying a refractory oxide coating containing an oxide less stable than $SiO_2$ at temperatures up to 2150° F.; and final texture annealing the steel.

16 Claims, No Drawings

PROCESSING FOR ELECTROMAGNETIC SILICON STEEL

The present invention relates to an improvement in the manufacture of grain-oriented silicon steels.

U.S. patent application Ser. No. 696,967, filed June 17, 1976, now U.S. Pat. No. 4,102,713, issued July 25, 1978 discloses a means for improving the quality of base coatings formed on boron-inhibited silicon steels. An oxide less stable than $SiO_2$ at temperatures up to 2150° F. is incorporated within the coating. A certain amount of oxygen is the scale (as oxides, particularly $SiO_2$) is required to render a surface susceptible to formation of a high quality base coating; and an oxide less stable than $SiO_2$ provides a means for attaining the result.

Through the present invention, there is provided a means for improving the quality of base coatings formed on boron-free silicon steels (steels to which boron is not an intentional addition). An oxide less stable than $SiO_2$ is incorporated within the coating, as is the case for Ser. No. 696,967. A relatively dry final normalize is also employed. Unlike Ser. No. 696,967, the drier atmosphere is not used to improve magnetic properties, but rather to improve the quality of the base coating. At the very least, a most startling discovery as drier atmospheres contribute less oxygen to the scale.

Various references disclose final normalizing atmospheres within the scope of the present invention. These references which include U.S. Pat. Nos. 3,151,005, 3,954,521 and 4,000,015, do not speak of an oxide less stable than $SiO_2$. Other references, such as U.S. Pat. Nos. 3,627,594, 3,700,506 and 3,868,280 disclose base coatings containing an oxide less stable than $SiO_2$. Of them, U.S. Pat. Nos. 3,627,594 and 3,868,280 speak of final normalizing conditions. U.S. Pat. Nos. 3,627,594 and 3,868,280 do not, however, disclose a specific normalizing atmosphere having a $p_{H_2O}/p_{H_2}$ as low as 0.3, the maximum imposed upon the present invention. The lowest specific value therein is 0.34. A $p_{H_2O}/p_{H_2}$ of 0.34 corresponds to a dew point of 61° C. in disassociated ammonia. Although lower values can be attributed to the range of dew points disclosed in these patents, their specific teachings are contradictory to such. Moreover, they primarily relate to aluminum-inhibited silicon steels and not to aluminum-free steels (steels to which aluminum is not an intentional addition), as is the case for the present invention.

It is accordingly an object of the present invention to provide an improvement in the manufacture of grain-oriented silicon steel.

In accordance with the present invention a melt of silicon steel consisting essentially of, by weight, up to 0.07% carbon, from 0.01 to 0.25% manganese, from 0.01 to 0.09% of material from the group consisting of sulfur and selenium, from 2.5 to 4.0% silicon, up to 1.0% copper, less than 0.009% aluminum, less than 0.006% boron, balance iron is subjected to the conventional steps of casting, hot rolling, one or more cold rollings, an intermediate normalize when two or more cold rollings are employed, final normalizing, decarburizing, application of a refractory oxide coating and final texture annealing; and to the improvement comprising the steps of final normalizing the steel in a hydrogen-bearing atmosphere having a $p(\text{partial pressure})_{H_2O}/p(\text{partial pressure})_{H_2}$ of from 0.015 to 0.3; coating the surface of the steel with a refractory oxide coating consisting essentially of:

(a) 100 parts, by weight, of at least one substance from the group consisting of oxides, hydroxides, carbonates and boron compounds of magnesium, calcium, aluminum and titanium;

(b) up to 100 parts, by weight, of other substances from the group consisting of boron and compounds thereof;

(c) from 0.1 to 100 parts, by weight, of at least one oxide less stable than $SiO_2$ at temperatures up to 2150° F., said oxide being of an element other than boron;

(d) up to 40 parts, by weight, of $SiO_2$;

(e) up to 20 parts, by weight, of inhibiting substances other than boron; and (f) up to 10 parts, by weight, of fluxing agents;

and final texture annealing the steel with the coating thereon. For purposes of definition, "one part" equals the total weight of (a) hereinabove, divided by 100. The final normalize is that anneal to which the cold rolled steel of final gage is subjected to prior to coating and final texture annealing. Decarburization usually occurs during said anneal. As a general rule the melt has less than 0.008% aluminum and less than 0.0005% boron.

Specific processing, as to the conventional steps, is not critical and can be in accordance with that specified in any number of publications including U.S. Pat. No. 2,867,557. The term casting is intended to include continuous casting processes. A hot rolled band heat treatment is also includable within the scope of the present invention.

A refractory oxide base coating having an oxide less stable than $SiO_2$ at temperatures up to 2150° F. is applied to the boron-free silicon steel of the present invention in order to improve the quality of the coatings formed thereon. A certain amount of oxygen is the scale (as oxides, particularly $SiO_2$) is required to render a surface susceptible to formation of a high quality base coating; and an oxide less stable than $SiO_2$ provides a means for attaining this result. An oxide less stable than $SiO_2$ is one having a free energy of formation less negative than $SiO_2$ under the conditions encountered during a high temperature anneal. However, insofar as these conditions are difficult to determine, a standard free energy of formation diagram is used to determine stability.

The oxide less stable than $SiO_2$ should be present in a range of from 0.1 to 100 parts, by weight, as described hereinabove. A level of at least 1 part is, however, preferred. Maximum amounts are generally less than 30 parts, by weight. Typical oxides are those of manganese and iron. To date, $MnO_2$ is preferred.

The specific mode of applying the coating of the subject invention is not critical thereto. It is just as much within the scope of the subject invention to mix the coating with water and apply it as a slurry, as it is to apply it electrolytically. Likewise, the constituents which make up the coating can be applied together or as individual layers. Boron may be added to improve the magnetic properties of the steel. Typical sources of boron are boric acid, fused boric acid ($B_2O_3$), ammonium pentaborate and sodium borate. The additional inhibiting substances includable within the coating are usually from the group consisting of sulfur, sulfur compounds, nitrogen compounds, selenium and selenium compounds. Typical fluxing agents include lithium oxide, sodium oxide and other oxides known to those skilled in the art.

Another measure taken to improve the quality of the base coating formed on the boron-free silicon steel of the present invention, is a relatively dry final normalize. The steel is normalized in a hydrogen-bearing atmosphere having a $p_{H_2O}/p_{H_2}$ of from 0.015 to 0.3. The use of such a normalizing atmosphere has been unexpectedly found to eliminate or minimize anneal pattern. As a certain amount of scale oxygen is required to render a surface susceptible to formation of a high quality base coating, it would have been reasonable to assume that higher, and not lower ratios are superior. Such is not the case when a low ratio is used in conjunction with a base coating containing an oxide less stable than $SiO_2$ at temperatures up to 2150° F. For this reason, the subject invention employs said noted ratio of from 0.015 to 0.3. Ratios of from 0.05 to 0.180 have been found to be particularly beneficial. The hydrogen-bearing atmosphere is generally one of hydrogen and nitrogen. With such atmospheres the dew-point will generally be from +20° to +95° F. An 80% nitrogen, 20% hydrogen atmosphere has been found to be particularly beneficial. Normalizing temperatures can range from 1300° to 2000° F. Temperatures of from 1400° to 1550° F. are particularly desirable for the final normalize as decarburization proceeds most effectively at a temperature of about 1475° F. Time at temperature is usually from ten seconds to ten minutes.

The following examples are illustrative of several aspects of the invention.

EXAMPLE I

Four groups (Group A through D) of silicon steel samples were cast and processed into silicon steel having a cube-on-edge orientation. Each of the samples had a melt chemistry within that set forth for the present invention. Processing for the samples involved soaking at an elevated temperature for several hours, hot rolling to a nominal gage of 0.080 inch, hot roll band normalizing, cold rolling to intermediate gage, normalizing, cold rolling to final gage, final normalizing and decarburizing at a temperature of 1475° F. for about two minutes in an 80% nitrogen, 20% hydrogen atmosphere, coating as described hereinbelow in Table I, and final texture annealing at a maximum temperature of 2150° F. in hydrogen.

TABLE I

| Group | MgO (Parts, by wt.) | $MnO_2$ (Parts, by wt.) | B (Parts, by wt.) | $MgSO_4 \cdot 7H_2O$ (Parts, by wt.) |
|---|---|---|---|---|
| A. | 100 | — | — | — |
| B. | 100 | 5 | — | — |
| C. | 100 | 5 | 0.3 | — |
| D. | 100 | — | — | 1.3 |

Note that the coatings applied to Groups A and D were free of $MnO_2$, whereas that applied to Groups B and C had 5 parts, by weight, of $MnO_2$.

The coatings formed during the final texture anneal were subsequently examined, after excess MgO was scrubbed off. Table II. reports the results of said examination.

TABLE II.

| Group | Sample | Coating |
|---|---|---|
| A. | 1. | Anneal pattern, mottled, not uniform |
| | 2. | Anneal pattern, mottled, not uniform |
| B. | 3. | Opague, good, uniform coating |
| | 4. | Opague, excellent shiny uniform coating |
| | 5. | Opague, good slight anneal pattern |
| C. | 6. | Opague, excellent, uniform coating |
| | 7. | Opague, excellent, uniform coating |
| | 8. | Opague, excellent, uniform coating |
| | 9. | Opague, excellent, uniform coating |
| D. | 10. | Anneal pattern, not uniform |
| | 11. | Anneal pattern, not uniform |

Significantly, a high quality coating formed on Group B and C samples which received a coating in accordance with the subject invention, and not on Group A and D samples which did not. The coatings applied to Group B and C samples had $MnO_2$, whereas those applied to Group A and D samples did not; and, as discussed hereinabove, the present invention requires a coating which contains an oxide less stable than $SiO_2$.

EXAMPLE II

Additional samples of silicon steel were cast and processed into silicon steel having a cube-on-edge orientation. As with Example I, each of these samples had a melt chemistry within that set forth for the present invention. Processing for the samples involved soaking at an elevated temperature for several hours, hot rolling to a nominal gage of 0.080 inch, hot roll band normalizing, cold rolling to intermediate gage, normalizing, cold rolling to final gage, final normalizing and decarburizing at a temperature of 1475° F. for about two minutes in an 80% nitrogen, 20% hydrogen atmosphere having a $p_{H_2O}/p_{H_2}$ of from 0.1 to 0.15, coating as for Group B in Example I, and final texture annealing at a maximum temperature of 2150° F. in hydrogen. The $p_{H_2O}/p_{H_2}$ of from 0.1 to 0.15 is equivalent to a +65° to +75° F. dew-point.

The coatings formed during the final texture anneal were subsequently examined. They were found to be superior to others formed from steel decarburized in a wetter atmosphere. Specifically, they were found to be superior to those formed from steel decarburized in an atmosphere having a $p_{H_2O}/p_{H_2}$ in excess of 0.3. The referred to superiority is particularly evident with regard to elimination or minimization of anneal pattern.

It will be apparent to those skilled in the art that the novel principles of the invention disclosed herein in connection with specific examples thereof will suggest various other modifications and applications of the same. It is accordingly desired that in construing the breadth of the appended claims they shall not be limited to the specific examples of the invention described herein.

We claim:

1. In a process for producing electromagnetic silicon steel having a cube-on-edge orientation, which process includes the steps of: preparing a melt of silicon steel having up to 0.07% carbon, from 0.01 to 0.25% manganese, from 0.01 to 0.09% of material from the group consisting of sulfur and selenium, from 2.5 to 4.0% silicon, up to 1.0% copper, less than 0.009% aluminum and less than 0.0006% boron; casting said steel; hot rolling said steel; cold rolling said steel; decarburizing said steel; annealing said cold roll steel of final gage; applying a refractory oxide coating to said steel; and final texture annealing said steel; the improvement comprising the steps of annealing said cold roll steel of final gage in a hydrogen-bearing atmosphere having a $p_{H_2O}/p_{H_2}$ of from 0.015 to 0.3; coating the surface of said steel with a refractory oxide coating consisting essentially of:

(a) 100 parts, by weight, of at least one substance from the group consisting of oxides, hydroxides, carbonates and boron compounds of magnesium, calcium, aluminum and titanium;

(b) up to 100 parts, by weight, of other substances from the group consisting of boron and compounds thereof;

(c) from 0.1 to 100 parts, by weight, of at least one oxide less stable than $SiO_2$ at temperatures up to 2150° F., said oxide being of an element other than boron;

(d) up to 40 parts, by weight, of $SiO_2$;

(e) up to 20 parts, by weight, of inhibiting substances; and (f) up to 100 parts, by weight, of fluxing agents;

and final texture annealing said steel with said coating thereon.

2. An improvement according to claim 1, wherein said coating has at least 1 part, by weight, of at least one oxide less stable than $SiO_2$.

3. An improvement according to claim 1, wherein said oxide less stable than $SiO_2$ is from the group consisting of oxides of manganese and iron.

4. An improvement according to claim 3, wherein said oxide is an oxide of manganese.

5. An improvement according to claim 1, wherein said cold roll steel of final gage is annealed in a hydrogen-bearing atmosphere having a $p_{H_2O}/p_{H_2}$ of from 0.05 to 0.180.

6. An improvement according to claim 5, wherein said oxide less stable than $SiO_2$ is from the group consisting of oxides of manganese and iron.

7. An improvement according to claim 6, wherein said oxide is an oxide of manganese.

8. An improvement according to claim 1, wherein said hydrogen-bearing atmosphere consists essentially of hydrogen and nitrogen.

9. An improvement according to claim 8, wherein said hydrogen-bearing atmosphere has a dew-point of from +20° to +95° F.

10. An improvement according to claim 9, wherein said oxide less stable than $SiO_2$ is from the group consisting of oxides of manganese and iron.

11. An improvement according to claim 10, wherein said oxide is an oxide of manganese.

12. An improvement according to claim 9, wherein said hydrogen-bearing atmosphere is 80% nitrogen, 20% hydrogen.

13. An improvement according to claim 1, wherein cold roll steel of final gage is annealed at a temperature of from 1300° to 2000° F.

14. An improvement according to claim 13, wherein said cold roll steel of final gage is annealed at a temperature of 1400° to 1550° F.

15. An improvement according to claim 13, wherein said cold roll steel is annealed for a period of from 10 seconds to 10 minutes.

16. A cube-on-edge oriented silicon steel made in accordance with the process of claim 1.

* * * * *